US008108974B2

(12) United States Patent
Graf

(10) Patent No.: US 8,108,974 B2
(45) Date of Patent: Feb. 7, 2012

(54) CLOSURE FOR JOINING AT LEAST TWO PIECES OF MATERIAL

(75) Inventor: Michaela Graf, Tenerife (ES)

(73) Assignee: T.SP-Gilmor Ltd., Manchester (GB)

( * ) Notice: Subject to any disclaimer, the term of this patent is extended or adjusted under 35 U.S.C. 154(b) by 758 days.

(21) Appl. No.: 12/158,126

(22) PCT Filed: Jun. 23, 2006

(86) PCT No.: PCT/EP2006/006037

§ 371 (c)(1),
(2), (4) Date: Jun. 19, 2008

(87) PCT Pub. No.: WO2007/079786

PCT Pub. Date: Jul. 19, 2007

(65) Prior Publication Data

US 2008/0313870 A1 Dec. 25, 2008

(30) Foreign Application Priority Data

Dec. 22, 2005 (DE) ..... 20 2005 020 502 U
Mar. 9, 2006 (DE) ..... 10 2006 010 774

(51) Int. Cl.
*A44B 13/00* (2006.01)

(52) U.S. Cl. ..... 24/578.14; 24/686

(58) Field of Classification Search ..... 24/97, 102 PL, 24/578.1, 578.14, DIG. 31, DIG. 32, DIG. 35, 24/707.8, 518, 609, 611, 453, 698.1, 684, 24/686, 66.11, 66.12, 66.8, 66.2, 66.7
See application file for complete search history.

(56) References Cited

U.S. PATENT DOCUMENTS

| | | | | |
|---|---|---|---|---|
| 2,161,260 | A | 6/1939 | Mattfeldt | |
| 2,963,759 | A | 12/1960 | Marien | |
| 2,969,572 | A | 1/1961 | Poe | |
| 3,583,040 | A | 6/1971 | Terrell et al. | |
| 3,899,802 | A * | 8/1975 | Koehle | 24/599.9 |
| 3,905,069 | A * | 9/1975 | Szomanski | 24/376 |
| 4,074,396 | A | 2/1978 | Swimley | |
| 4,429,439 | A * | 2/1984 | Waugh | 24/578.1 |
| 5,826,313 | A | 10/1998 | Ishizaki | |

FOREIGN PATENT DOCUMENTS

| | | |
|---|---|---|
| DE | 74 16 308 | 3/1975 |
| DE | 696 05 176 | 4/2000 |

* cited by examiner

*Primary Examiner* — James Brittain
(74) *Attorney, Agent, or Firm* — Michael J. Striker

(57) ABSTRACT

Disclosed is a closure for joining at least two pieces of material, especially layers of material (14, 20). Said closure comprises two closure elements (2, 3) which are spaced apart in some sections. The first closure element (2) is provided with at least one fastening means (7) while the second closure element (3) is fitted with an especially central gap (4).

15 Claims, 2 Drawing Sheets

Fig. 7
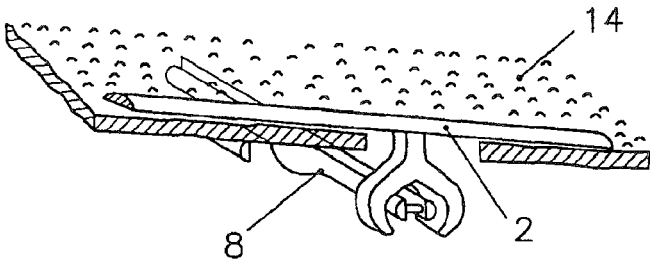
Fig. 8
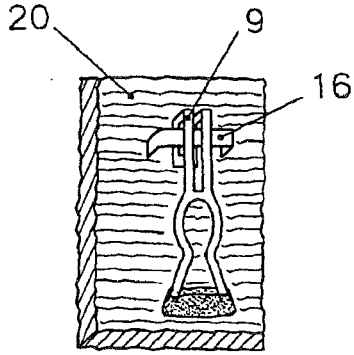
Fig. 9
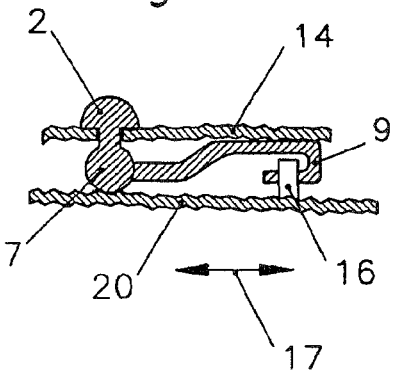
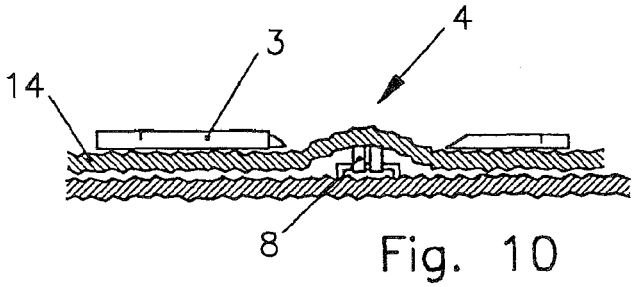
Fig. 10
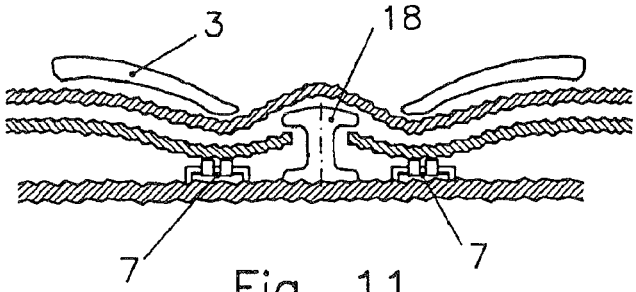
Fig. 11

CLOSURE FOR JOINING AT LEAST TWO PIECES OF MATERIAL

CROSS-REFERENCE TO RELATED APPLICATIONS

This application claims priority under 35 U.S.C. 119(a)-(d) to German Patent Application Number DE 20 2005 020 502.8, filed Dec. 22, 2005 and German Patent Application Number DE 20 2006 010 774.8, filed Mar. 9, 2006.

BACKGROUND OF THE INVENTION

1. Field of the Invention

The invention relates to a closure for joining at least two pieces of material, in particular layers of material, having two intermittently spaced apart closure elements.

2. Description of Related Art

As closures for joining at least two pieces of material, safety pins are for instance known. A safety pin, in a simple version, is a pin bent into a U, on the ends of which is a sheath. This sheath is solidly connected to one end of the needle, and thus that side is rigid, while the other side, which tapers to a point and thus has a piercing function, is movable within its tension radius. Thus this side of the needle can be introduced into the lateral slit, located on the inside, in the sheath. To increase the tension, the simple U-shape is often additionally shaped into a screw. With the safety pin, two parts lying on one another can be pinned together and held. Thus it serves as a closure. Safety pins that are designed in the form of a piece of jewelry are called brooches. It is thus left to the user whether he would like to use it only as a piece of jewelry or also make use of its function as a connecting means.

From the standpoint of fashion, it can be desirable to use safety pins as an alternative or in addition to buttons, zippers, hooks, and so forth, for instance as a possible closure for pants, t-shirts, jackets, handbags, shoes, and so forth. Both the piercing function and the movability of the part of the safety pin that performs the piercing function involve risks of injury to the user. Hence a safety pin, with its typical properties, is unsuitable as a closure of the type on which the utility or use of a product depends.

BRIEF SUMMARY OF THE INVENTION

The object of the present invention is therefore to create a closure that presents no risk of injury to a user.

This object is attained according to the invention in a manner that is as surprising as it is simple, by means of a closure of the type defined at the outset, with the provision that the first closure element has at least one fastening means, and the second closure element has an interruption. With such a closure, joining of a plurality of layers of material, for instance a plurality of parts of an item of clothing, can be done via the fastening means without representing a risk of injury to a user. By means of the interruption of the one closure element, the appearance of a safety pin in use, that is, a safety pin introduced into one layer of material, can nevertheless be achieved. The closure is preferably made from a metal, in particular a noble metal, or a metal alloy. The choice of materials can be made to suit the expected stress on the closure.

In one embodiment, the first and second closure elements can be connected to one another at two points. Preferably, they are connected to one another at their ends. As a result, the first and second closure elements can be disposed essentially parallel to one another and can thus have the appearance of a conventional safety pin. For that purpose, one connection point is advantageously equipped with a sheath in the manner of a safety pin, while the other connection point is embodied as U-shaped or with a helical shape.

If the device is in the form of a safety pin interrupted on one side, then in the closed state the closure looks like a safety pin that has pierced the material which it decorates. This optical illusion is attained by providing that one side of the safety pin, which in a conventional safety pin performs the piercing function, is visibly clearly interrupted.

In an especially preferred embodiment, it may be provided that the fastening means is embodied as a hinge, which with its movable hinge part can engage a piece of material from behind. Because of the movability of the hinge, the movable hinge part can simply be thrust through an opening in one layer of material.

Advantageously, the hinge is embodied as a swing clamp hinge. By way of such a hinge, a layer of material can be held and adapted especially well. The swing clamp hinge can be embodied similarly to the hinge used for earrings.

It is especially preferred if the movable hinge part, on its free end, has a hooklike extension. A hooklike extension can absorb tensile stresses especially well and is easy to manipulate. The hooklike extension can be embodied on the movable hinge part, or can be an additional element attached to it.

Preferably, the fixed hinge part, joined to the first closure element, has a strut, whose length is approximately equivalent to the thickness of one layer of material. As a result, on the one hand, a good seat of the closure on the layer of material is achieved, since the strut is not overly long, and on the other, the movability of the hinge is unimpaired, since the strut is not too short.

In an especially preferred embodiment, it can be provided that the fastening means is designed for a predetermined tensile stress. The tensile stress can be adjusted for instance by means of the choice of material, the material thickness, and the bending, curvature or arching as well as the size of the hooklike extension and/or of the hinge parts. By means of a suitable curvature or arching of the hinge and of the hooklike extension, various contact pressure points of the layer of material against the closure can be defined. By means of these parameters, the contact pressure of the hinge can also be adjusted.

It is especially preferable if an eyelet for the hooklike extension to catch on is provided, which is disposed on one piece of material, and the length of the movable hinge part is adapted to the position of the eyelet. This yields an especially simple closure option for two pieces of material.

In a refinement, it may be provided that the shape and size of the hooklike extension are adapted to the eyelet.

The optical illusion effected by the closure of the invention appears especially realistic if the fastening means is disposed approximately centrally, relative to the interruption of the second closure element. Joining by using only one fastening means may suffice, if the closure is neither too large nor too heavy and if the material to be joined is not too thin, too thick, or too immovable. However, if more stringent demands in terms of the strain on the closure are made, then it may be useful to provide a plurality of fastening means; for instance, one fastening means can be provided in each of the end regions of the interruption of the second closure element.

Further advantages are obtained if a decorative piece is attached to the first closure element, or the first closure element is embodied as such a decorative piece. As a result, the closure can also be used as a piece of jewelry.

In one embodiment of the invention, it may be provided that the first closure element, in particular the decorative piece, is joined inseparably, in particular by means of rivets, to one layer of material. As a result, it is held on a layer of material in such a way that it cannot be lost. This is especially advantageous if the closure according to the invention is used with an item of clothing.

In one embodiment, it may be provided that the first closure element is connected to the second closure element at a first point, and the first closure element is connected to the second closure element at a second point, by means of a sheathlike structure. The sheathlike structure can simulate the closure of a safety pin.

Advantageously, the first and second closure elements are adapted to the sheathlike structure, and/or the sheathlike structure is adapted to the first and second closure elements.

In one embodiment, on the first and/or second closure element, a connecting means can be provided for connecting the closure elements to one another. If one connecting element each is provided, then these can be adapted to one another.

One embodiment is distinguished in that a connecting means is provided on the first closure element, and the second closure element has the form of a safety pin interrupted on one side and can be secured to the connecting means of the first closure element. The second closure element can for instance be pinned or clipped onto a suitably embodied first closure element. In that case, the first and second closure elements are connected to one another at only one point.

Further characteristics and advantages of the invention will become apparent from the ensuing detailed description of exemplary embodiments of the invention in conjunction with the drawings, which show details essential to the invention, and from the claims. The individual characteristics may be implemented individually on their own or in a plurality of arbitrary combinations in variants of the invention.

In the schematic drawings, exemplary embodiments of the invention are shown, which are described in further detail in the ensuing description.

BRIEF DESCRIPTION OF THE DRAWINGS

FIG. 7, a perspective view of a fastening means, passed through one layer of material, with a movable hinge part swung against it;

FIG. 8, a top view on a second layer of material, with an eyelet from which the movable hinge part is suspended;

FIG. 9, a sectional view through a closure that joins two layers of material with one another;

FIG. 10, a longitudinal sectional view through a closure that joins two layers of material with one another; and FIG. 11, a further sectional view, in which a closure according to the invention and conventional types of closure, such as buttons, are used in alternation for the closing.

DETAILED DESCRIPTION OF THE INVENTION

Figure 1:
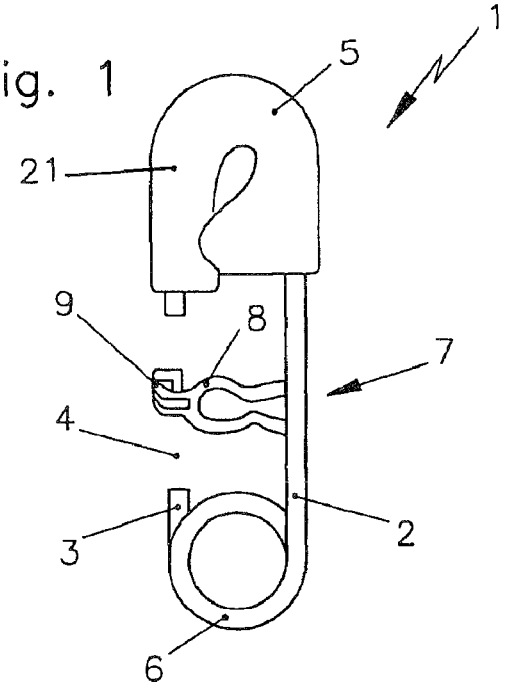
FIG. 1, a first exemplary embodiment of a closure with one fastening means.

In FIG. 1, a closure 1 is shown, which has a first closure element 2 and spaced apart from it in some portions a second closure element 3, and the closure element 3 has an interruption 4. At the points 5, 6, the closure elements 2, 3 are connected to one another. The closure 1 has the shape of a safety pin with an interruption 4. On the first closure element 2, a fastening means 7 is provided, which has a movable hinge part 8 on which a hooklike extension 9 is located. The fastening means 7 is disposed centrally relative to the interruption 4. On the end 5, the connection is embodied as a sheathlike structure 21, which can be connected in material-locking fashion to the closure elements 2, 3 or maybe a separate part which is adapted for connecting the closure elements 2, 3.

Figure 2:
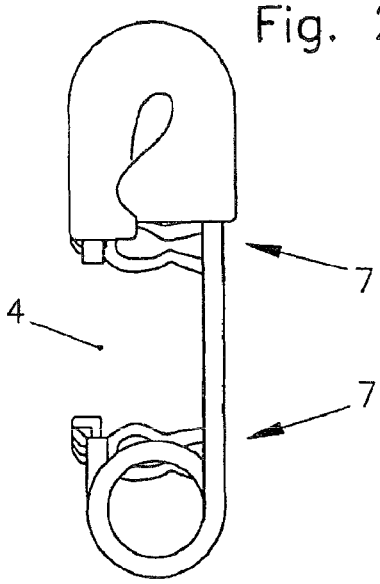
FIG. 2, a second exemplary embodiment of a closure with two fastening means.

In the embodiment of FIG. 2, two fastening means 7 are provided, and these are disposed in the end regions of the interruption 4. The angle at which the fastening means 7, in particular a fixed part of the fastening means 7, is attached can be predetermined. As a result, the contact pressure of the closure 1 against a layer of material can be adjusted, and further parameters can also be taken into account, such as the thickness, strength, and so forth of the layer of material. The contact pressure can also be adjusted by means of the curvature, arching, and so forth of the first closure element 2, including in conjunction with a required tensile stress, or by means of a curvature, arching, and so forth of the closure 1. Individual contact pressure points can be defined both by way of suitable shaping, in particular curvature and arching, of the closure 1 and via suitable shaping, in particular arching and curvature, of the fastening means 7 and of the hooklike extension 9.

Figure 3:
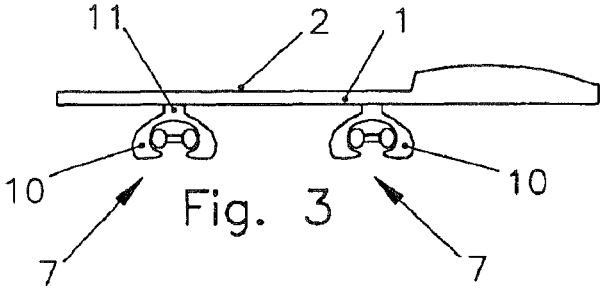
FIG. 3, a side view of the closure in the second exemplary embodiment.

From the side view in FIG. 3, it can be seen that the fastening means 7 are attached with a fixed hinge part 10 to the first closure element 2. The length of the strut 11 should be dimensioned such that it is approximately equivalent to the thickness of one layer of material.

Figure 4:
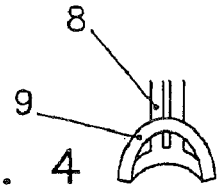
FIG. 4, a detail of a hooklike extension of a fastening means.

In FIG. 4, it is shown that the hooklike extension 9 on the movable hinge part 8 can be embodied as hooks, shaped from the bend.

Figure 5:
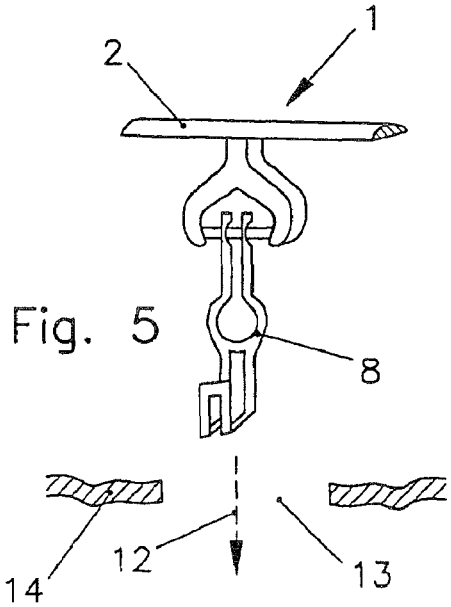
FIGS. 5 and 6, views to explain the mode of operation of the closure.

In the closure 1 shown in FIG. 5, the first closure part 2 is embodied in platelike form. In this case, the closure 1 has only the closure part 2. However, the closure shown in FIG. 5 could also be combined with a second closure element. The first closure part 2 can be embodied as a decorative piece.

The movable hinge part 8 is swung open and can thus be thrust in the direction of the arrow 12 through an opening 13 in one layer of material 14. The movable hinge part 8 preferably has locking opening angles of 90° and 180° relative to the first closure part 2. In the 180° position, the movable hinge part 8 can pass through the opening 13. After that, the hinge part 8 can be briefly swung closed and then opened again. As a result, the layer of material 14 can be brought particularly well into contact with the first closure element 2.

Figure 6:
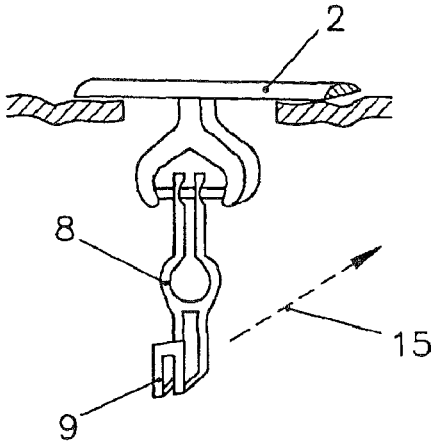

The thrust-through position can be seen in FIG. 6. Next, the movable hinge part 8 can be swung over in the direction of the arrow 15. It becomes clear from this that the hooklike extension 9, with the hinge part 8 swung closed, is bent away from the first closure element 2.

In FIG. 7, it can be seen that the first closure part 2 is braced on the layer of material 14. Below the layer of material 14, the hinge part 8 is swung closed.

FIG. 8 shows a top view on a second layer of material 20, on which an eyelet 16 is secured. The hooklike extension 9 is suspended from the eyelet 16. As a result, two layers of material, in particular of an item of clothing, can be joined together.

In the cross-sectional view in FIG. 9, it can be seen that the first closure part 2 is located above the first layer of material 14. The movable part 8 is swung closed in the direction of the first closure part 2. The hook extension 9 is suspended from the eyelet 16 that is secured to the second layer of material 20. A result of this arrangement is that in suspended and closed state, a relative motion of the first and second layers of material 14, 20 in the double-arrow direction 17 is prevented.

In the sectional view in FIG. 10, it can be seen that the first layer of material 14 arches upward in the interruption 4 of the second closure element 3. This happens because the layer of material 14 lies across the movable hinge part 8 of the fastening means. This gives the impression as if the first layer of material 14 were pierced by a pin. Because of the upward bulge, the closure 1 is held more firmly in its intended position. To strengthen the impression of being pierced by a pin, the portions of the second closure element 3 that define the interruption 4 can be bent downward.

From FIG. 11, it can be seen that the second closure element 3 can be embodied as bent. The fastening means 7 and further closure devices 18, such as a button, can be located in alternation perpendicular to the plane of the drawing.

The invention claimed is:

1. A closure (1) for joining at least two layers of material (14, 20), having two intermittently spaced apart closure elements (2, 3), in which the first closure element (2) has at least one fastening means (7), and the second closure element (3) has an interruption (4), wherein the fastening means (7) has one fixed part (10) and one movable part (8), wherein the one moveable part (8) includes a hook structure (9) at a free end that is pivotable relative to the fixed part (10) and which is capable of engaging one of the two layers of material from behind.

2. The closure as defined by claim 1, wherein the first and second closure elements (2, 3) are connected to one another at two points.

3. The closure as defined by claim 1, wherein the closure (1) has the form of a safety pin interrupted on one side.

4. The closure as defined by claim 1, wherein the fastening means (7) is embodied as a hinge.

5. The closure as defined by claim 1, wherein the pivotable part (8) has at least one locking opening angle relative to the first closure part (2).

6. The closure as defined by claim 1, wherein the fixed part (10), connected to the first closure element (2), has a strut (11), whose length is approximately equivalent to the thickness of one of the two layers of material.

7. The closure as defined by claim 1, wherein an eyelet (16) for the hook extension (9) to catch on is provided on one of the two layers of material, and a length of the movable hinge part (8) is adapted to the position of the eyelet (16).

8. The closure as defined by claim 7, wherein the shape and size of the hook extension (9) are adapted to the eyelet (16).

9. The closure as defined by claim 1, wherein a plurality of fastening means (7) is provided.

10. The closure as defined by claim 1, wherein a decorative piece is attached to the first closure element (2), or the first closure element (2) is embodied as a decorative piece.

11. The closure as defined by claim 10, wherein the first closure element (2), is connected inseparably, by means of rivets, to one of the two layers of material.

12. The closure as defined by claim 11, wherein the first closure element, which is the decorative piece, is connected inseparably, by means of rivets, to one of the two layers of material.

13. The closure as defined by claim 1, wherein the first closure element (2) is connected to the second closure element (3) at a first point, and the first closure element (2) is connected to the second closure element (3) at a second point, by means of a sheath structure (21).

14. The closure as defined by claim 1, wherein, on either the first closure element (2) or the second closure element (3), or both, a connecting means is provided for connecting the closure elements (2, 3) to one another.

15. The closure as defined by claim 1, wherein a connecting means is provided on the first closure element (2), and the second closure element (3) has the form of a safety pin interrupted on one side and capable of being secured to the connecting means of the first closure element (2).

* * * * *